US005678340A

United States Patent [19]

Moon

[11] Patent Number: 5,678,340

[45] Date of Patent: Oct. 21, 1997

[54] CARTRIDGE EXTRACTOR

[76] Inventor: Kook-Jin Moon, 630 Rte. 303, Blauvelt, N.Y. 10913

[21] Appl. No.: 536,009

[22] Filed: Sep. 29, 1995

[51] Int. Cl.[6] ..... F41A 3/00

[52] U.S. Cl. ..... 42/25; 42/46; 89/163

[58] Field of Search ..... 42/25, 16, 46; 89/163

[56] References Cited

U.S. PATENT DOCUMENTS

| | | | |
|---|---|---|---|
| 2,894,346 | 7/1959 | Smith | 42/69 |
| 3,090,148 | 5/1963 | Smith | 42/25 |
| 3,608,223 | 9/1971 | Dieckmann | 42/25 |
| 3,882,625 | 5/1975 | Iellie | 42/25 |
| 4,416,077 | 11/1983 | Thompson | 42/25 |
| 4,615,132 | 10/1986 | Smith | 42/25 |
| 4,676,017 | 6/1987 | Harlemann et al. | 42/25 |

FOREIGN PATENT DOCUMENTS

| | | |
|---|---|---|
| 727309 | 4/1943 | Germany . |
| 754952 | 12/1952 | Germany . |
| 249230 | 4/1926 | Italy . |
| 276177 | 9/1951 | Switzerland . |
| 280136 | 12/1927 | United Kingdom . |

*Primary Examiner*—J. Woodrow Eldred
*Attorney, Agent, or Firm*—Chilton, Alix & Van Kirk

[57] ABSTRACT

A semi-automatic breech locking pistol having a frame and an operating slide supported for reciprocal movement on the frame between battery and retired positions. An extractor supported for limited pivotal and lateral movement relative to the slide cooperates with an ejector mounted in fixed position on the frame. An abutment on the slide limits pivotal movement of the extractor to positively secure the extractor in engagement with the rim of an associated cartridge within the cannelure of the cartridge during the extracting portion of the pistol operating cycle. The extractor is free to move laterally of the operating slide when the breech is closed on a chambered cartridge to enable the extractor to engage and grip the rim of the chambered cartridge.

24 Claims, 4 Drawing Sheets

CARTRIDGE EXTRACTOR

BACKGROUND OF THE INVENTION

This invention relates in general to firearms and deals more particularly with an improved cartridge extractor for a firearm having a frame and an operating slide supported on the frame for reciprocal sliding movement relative to the frame between battery and retired positions. The cartridge extractor of the present invention, which is carried by the operating slide, is particularly suitable for use in a semi-automatic breech kicking pistol of the aforedescribed general type wherein the chamber end of the barrel moves downward to unlock the breech in response to an initial portion of the rearward movement of the operating slide and barrel from battery position.

In a firearm of the type with which the present invention is concerned, the extractor cooperates with an ejector, which is mounted in fixed position on the frame, during the election potion of the firearm operating slide cycle to elect a chambered live round of ammunition, when the slide is manually operated, or spent cartridge case, when the slide operates in the firing mode. In such a firearm the extractor is usually arranged to pivot to an electing position relative to the slide to release a chambered live round or spent cartridge case during the election portion of the operating cycle. However, this pivotal movement, essential to proper election, may cause problems during the cartridge extraction portion of the operating cycle. Specifically, if any unusual resistance to extraction is encountered the extractor may prematurely release the round or spent cartridge case allowing it to remain in a fury or partially chambered position within the firearm. The present invention is concerned with this problem.

It is the general aim of the invention to provide a firearm having an operating slide and which includes an improved cartridge extractor for positively locking onto and gripping the rim of a cartridge case or shell so that the shell cannot escape from the extractor during an extraction portion of the firearm operating cycle and for cooperating with an ejector during an ejection portion of the operating cycle. It is a further aim of the invention to provide an improved extractor for positively locking onto and gripping the rim of a chambered cartridge in the event that the operating slide is operated to close the breech with a cartridge disposed within the chamber.

SUMMARY OF THE INVENTION

In accordance with the invention, a firearm having a frame, an operating slide supported on the frame for reciprocal sliding movement between battery and retired positions and a cartridge ejector mounted in fixed position on the frame includes a cartridge extractor carried by the operating slide and having a claw for engaging the rim of an associated cartridge within the cannelure of the cartridge in an extracting position to extract the cartridge from the firearm during an extracting portion of the operating cycle of the firearm in response to movement of the operating slide from its battery toward its retired position. Means is provided for supporting the cartridge extractor on the slide to pivot relative to the slide from an inactive position to an extracting position in response to engagement with the rim of an associated cartridge. An arresting means limits the pivotal movement of the cartridge extractor from its inactive position to its extracting position to positively retain the cartridge extractor in its extracting position with the claw thereof disposed within the cannelure of an associated cartridge during the extracting portion of the operating cycle. A biasing means urges the cartridge extractor toward its inactive position.

DETAILED DESCRIPTION OF PREFERRED EMBODIMENT

Figure 1:
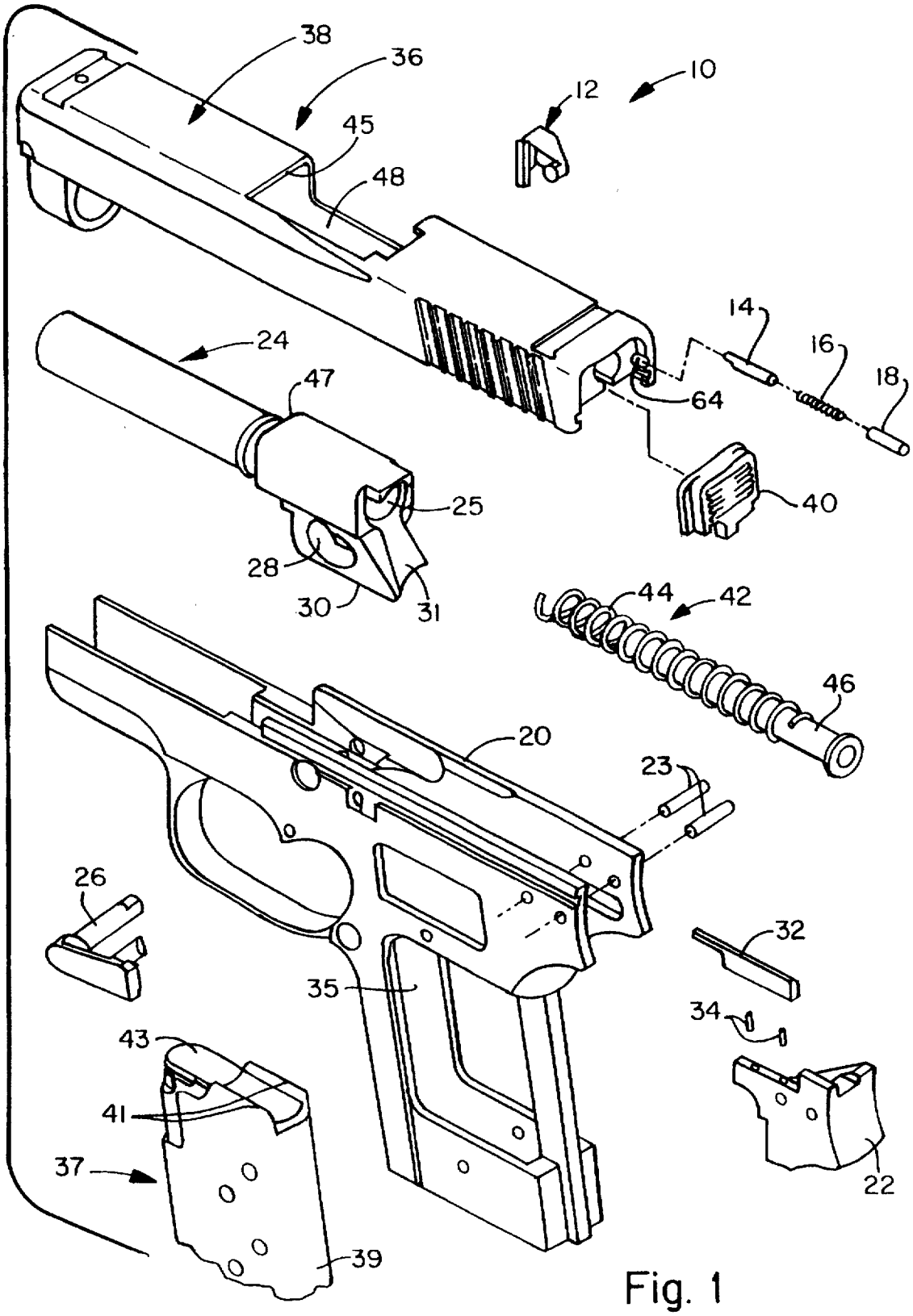
FIG. 1 is an exploded perspective view of a portion of a semi-automatic breech locking pistol having an extractor assembly embodying the present invention.

Referring now to the drawings, in FIG. 1 there is shown an exploded view of a portion of a semi-automatic firearm having an extractor assembly embodying the present invention and indicated generally by the reference numeral 10. The extractor assembly 10 includes an extractor 12, an extractor front pin 14, an extractor spring 16 and an extractor rear pin 18, all of which will be hereinafter further described. In FIG. 1, for clarity of illustration, only those parts of the firearm which relate to the operation of the extractor assembly 10 are shown.

The firearm illustrated in FIG. 1 is a semi-automatic pistol having a breech locking action and includes a frame assembly which comprises a frame 20 and a frame back 22 secured in fixed position at the rear of the frame 20 and between the sidewalls of the frame by pins 23, 23. A barrel indicated generally at 24 has a chamber 25 and is secured to the frame 20 for limited movement relative to the frame by a slide stop pin 26 supported by the frame sidewalls and extending through a cam opening 28 formed in a barrel cam lug 30 which depends from the chamber end of the barrel 24. The barrel cam lug 30 also defines a rearwardly facing and forwardly and upwardly inclined ramp surface 31 which leads to the barrel chamber 25. An ejector, indicated at 32 and disposed within an upwardly open receiver defined by the frame assembly, is mounted in fixed position on the frame back 22 by dowel pins 34, 34.

The frame assembly also defines a magazine well 35 for receiving a conventional detachable box magazine indicated generally at 37. The magazine includes a magazine tube 39 having opposing feed lips 41, 41 at its upper end and an upwardly biased magazine follower 43 for supporting a single column of cartridges (not shown) within the magazine tube in a conventional manner.

The extractor assembly 10 is carried by a longitudinally extending operating slide assembly, indicated generally at 36, which includes an operating slide designated generally by the numeral 38 and a slide back 40. The operating slide assembly 36 is supported by ways for reciprocal sliding movement on and longitudinally of the frame assembly between battery and retired positions in a manner well known in the firearm art. A recoil spring assembly indicated generally at 42, which includes a recoil spring 44 and a recoil spring guide 46, acts between the forward end of the operating slide 38 and a forwardly facing surface on the frame 20 (not shown) to bias the operating slide in a forward direction and toward battery position.

Figure 2:
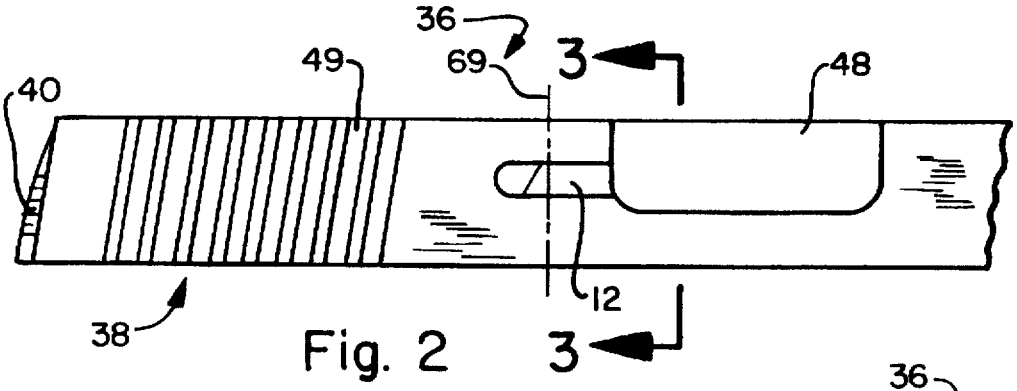
FIG. 2 is a somewhat enlarged side elevational view of the pistol operating slide assembly shown in FIG. 1.
Figure 5:
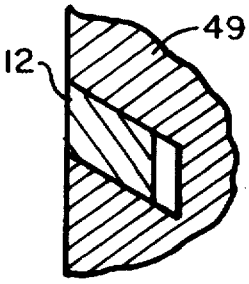
FIG. 5 is a fragmentary sectional view through the operating slide taken along the line 5—5 of FIG. 4.
Figure 3:
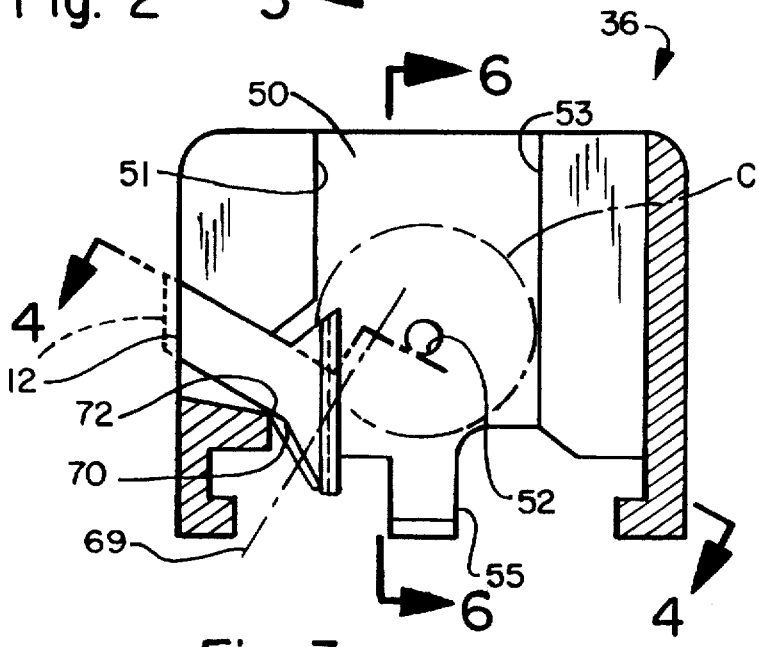
FIG. 3 is a somewhat further enlarged sectional view through the operating slide assembly taken along the line 3—3 of FIG. 2.
Figure 6:
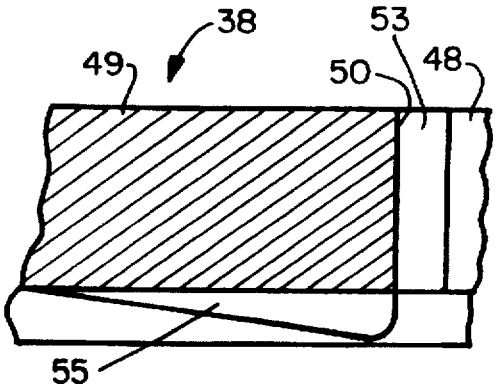
FIG. 6 is a somewhat reduced fragmentary sectional view through the operating slide assembly taken along the line 6—6 of FIG. 3.
Figure 7:
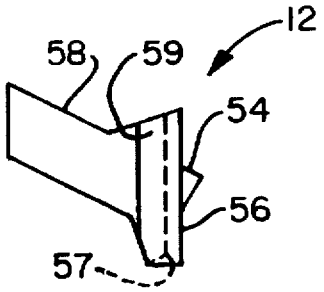
FIG. 7 is a front elevational view of the extractor as viewed from the front or muzzle end of the pistol.
Figure 8:
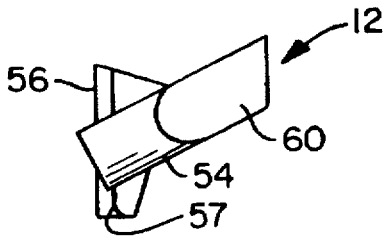
FIG. 8 is rear elevational view of the extractor as shown in FIG. 7.
Figure 9:
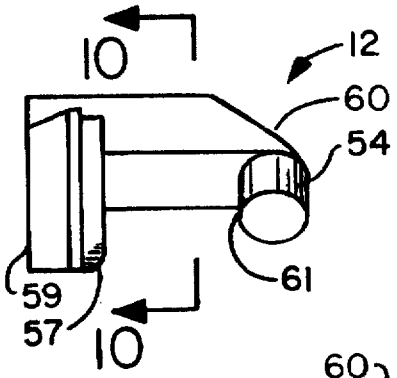
FIG. 9 is a right side elevational view of the extractor as shown in FIG. 7.
Figure 10:
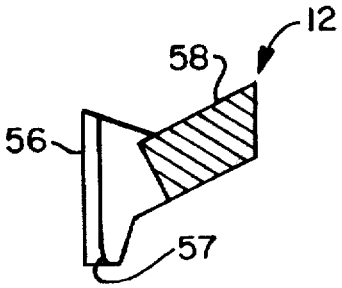
FIG. 10 is a sectional view taken along the line 10—10 of FIG. 9.
Figure 11:
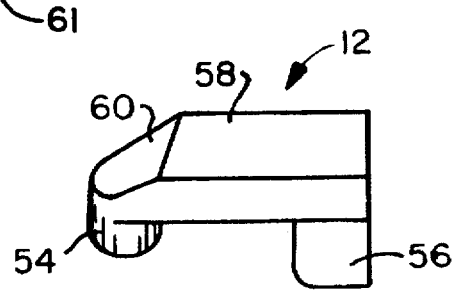
FIG. 11 is a left side elevational view of the extractor as it appears in FIG. 7.

Referring particularly to FIGS. 1–6, the operating slide assembly 36 and the manner in which the extractor assembly 10 is supported by the slide assembly will now be considered in further detail. The slide 38 has a hollow downwardly open forward end portion for receiving the barrel 24 therein and defines an upwardly and laterally outwardly open ejection port indicated by the numeral 48. A rearwardly facing edge of the ejection port, indicated at 45, cooperates with a forwardly facing surface 47 on the barrel to lock the operating slide in battery position. A rear portion of the slide 38 defines a breech bolt 49 which includes a forwardly facing breech surface 50 located at the rear of the ejection port 48. A pair of opposing laterally spaced apart and vertically disposed cartridge guide surfaces 51 and 53 extend forwardly from opposite sides of the breech face 50. An aperture 52 (FIG. 3) opens through the breech face 50 midway between the cartridge guide surfaces 51 and 53 for receiving a striker or firing pin (not shown). A forwardly and downwardly inclined longitudinally extending rib 55 depends from the breech bolt 49 centrally of the slide 38 and has a forwardly facing surface which forms a downward extension of the breech face 50 as shown in FIGS. 3 and 6.

Figure 12:
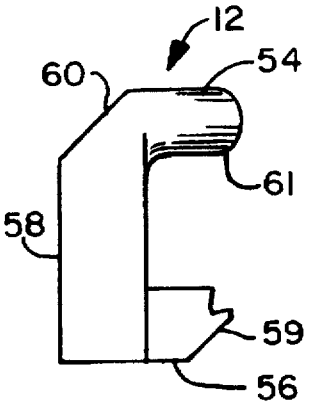
FIG. 12 is a top plan view of the extractor as shown in FIG. 7.
Figure 13:
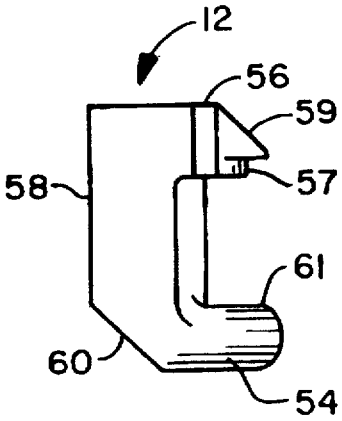
FIG. 13 is a bottom plan view of the extractor as shown in FIG. 7.
Figure 14:
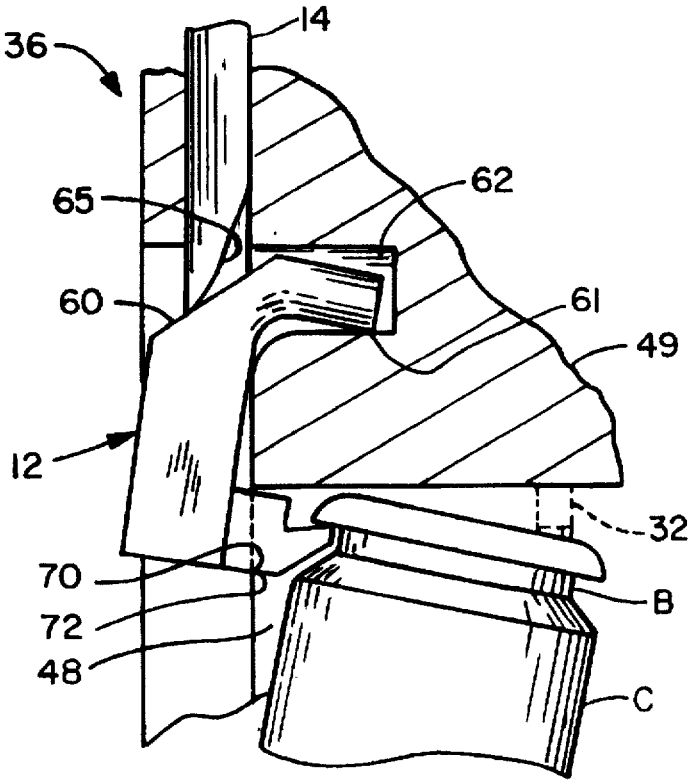
FIG. 14 is similar to FIG. 4 but shown with a cartridge in an ejecting position.

Considering now FIGS. 7–13, the extractor 12, shown in somewhat further detail, comprises a unitary structure and has a generally cylindrical rear pin 54, and a claw 56 integrally connected by and extending inwardly from opposite ends of a body portion indicated by the numeral 58. A cam surface 60 formed at the rear of the body portion 58 is forwardly and outwardly inclined from the outer end of the rear pin 54, substantially as shown in FIGS. 12–13. The claw 56 has an arcuately upwardly and inwardly curved lead surface 57 at its lower end and a forwardly facing and rearwardly and inwardly inclined cam surface 59 at its inner end. The rear pin 54 and a part of the body portion 58 is received within a laterally inwardly and downwardly inclined extractor receiving recess 62 formed in the operating slide 38 and opening through the breech face 50 and into the ejection port and best shown in FIGS. 4 and 5.

In accordance with the present invention, the extractor 12 is supported within the extractor receiving recess 62 and in straddling relation to an associated portion of the operating slide for limited pivotal movement and for limited lateral movement relative to the operating slide 38. The front and rear extractor pins 14 and 18 and the extractor spring 16, disposed therebetween, are received within a longitudinally extending bore 64 (FIG. 1) formed in the breech bolt 49, opening through the rear of the operating slide and communicating with the extractor receiving recess 62. The front and rear extractor pins 14 and 18 and the extractor spring 16 are retained within the bore 64 by assembly of the slide back 40 with the operating slide 38. A forwardly facing pivot point 61 on the inner peripheral edge of the rear pin 54 engages a fulcrum 63 defined by a portion of the surface of the recess 62 to support the extractor 12 for pivotal movement in a clockwise direction from an inactive position, indicated by broken lines in FIG. 4, to an extracting position, shown in full lines. More specifically the extractor 12 is supported within the recess 62 for upwardly and laterally outwardly pivotal movement from its inactive to its extracting position about an upwardly and laterally inwardly inclined axis 69 passing through the fulcrum 63 and disposed within a plane generally normal to the longitudinal axis of the operating slide 38. The general position of the axis 69 relative to the operating slide 38 is shown in FIGS. 2 and 3. An abutment 70 on the extractor cooperates with another abutment 72 on the operating slide to limit clockwise pivotal movement of the extractor from its inactive position to its extracting position of FIG. 4. The front extractor pin 14 has an arcuate cam surface 65 at its forward end for coengagment with the extractor cam surface 60 to bias the extractor 12 in a longitudinally forward direction and downwardly and laterally inwardly within the recess 62 and relative to the operating slide 38 and toward its inactive or broken line position of FIG. 4.

Considering now the operation of the extractor assembly 10, when the barrel chamber 25 is empty and a magazine 37 containing one or more cartridges is disposed within the magazine well 35, drawing the operating slide 38 rearwardly from its battery to its retired position causes the rib 55 on the underside of the breech bolt 49 to travel rearwardly between the lips 41, 41 at the upper end of the magazine tube 39 and along the length of the uppermost cartridge (not shown) contained within the magazine tube thereby biasing the uppermost cartridge downwardly within the magazine. When the slide 38 reaches its fully retired position the uppermost cartridge in the magazine is biased upwardly to a position wherein a portion of the rearwardly facing base surface of the cartridge is disposed immediately forward of the rib 55. Upon return movement of the operating slide from its retired position toward its battery position the rib 55 strips the upper most cartridge from the magazine 37 and advances it toward the barrel chamber. The forward end of the forwardly advancing cartridge engages and travels up the ramp surface 31 defined by the barrel lug 30 as the operating slide moves toward battery position. The chambered end of the barrel simultaneously moves upwardly toward its breech locking or normal firing position as the forward end of the advancing cartridge enters the barrel chamber 25. When the base or rear end of the cartridge clears the forward ends of the magazine lips 41, 41 the upwardly biased magazine follower 43 urges the base end of the advancing cartridge upwardly along the breech face 50 and into a position between the extractor claw and the breech face.

Figure 4:
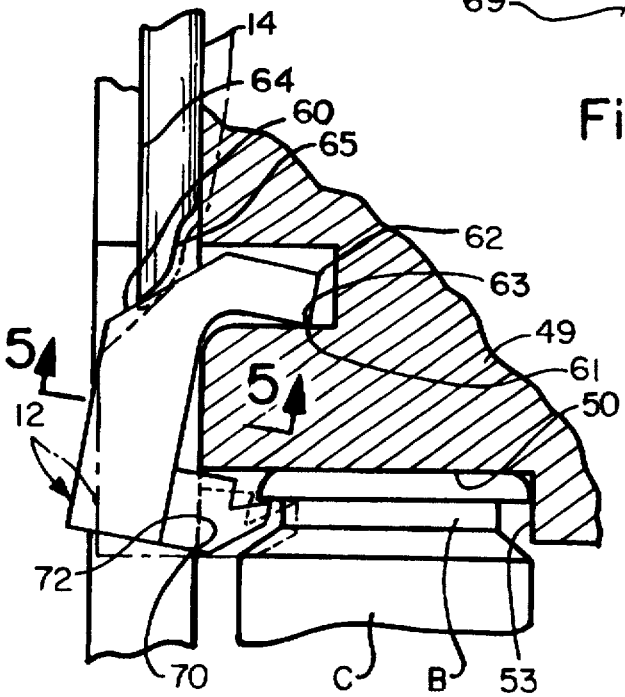
FIG. 4 is a fragmentary sectional view of the operating slide assembly taken generally along the line 4—4 of FIG. 3 and shown in extracting engagement with a cartridge.

Referring now to FIG. 4, as the cartridge, indicated by the letter C moves upwardly along the frontal surface of the rib 55 the rim of the cartridge initially engages the radial surface 57 on the claw urging the claw in a clockwise pivotal direction about the pivot point 61 on the inner end of the rear pin 54 against the biasing force of the extractor front pin 14 and the extractor spring 16. As the cartridge moves upwardly along the face breech face in response to the biasing force of the magazine follower 43 the extractor 12 pivots to its extracting and ejecting position, indicated by full lines in FIG. 4, in which position an associated portion of the claw 56 is disposed within the cartridge extracting groove or cannelure, indicated by the letter B. The cartridge C attains the latter position as the extractor 12 reaches the substantial limit of its clockwise pivotal movement (FIG. 4), such pivotal movement being limited by coengagement of the abutments 70 and 72 on the extractor and operating slide, respectively. The claw 56 remains positively secured in engagement with the cartridge rim within the cannelure B for as long as the cartridge remains in an extracting position with its base in engagement with the breech surface 50 and its longitudinal axis extending longitudinally of the operating slide. As the operating slide approaches its battery position the forwardly moving cartridge attains a fully chambered position wherein the cartridge base is in the position C indicated by broken lines in FIG. 4, the primer (not shown) is coaxially aligned with the firing pin or striker aperture 52 and the extractor claw 56 is in its extracting and ejecting position locked in engagement with the rim of the chambered cartridge and within the cannelure B of the cartridge.

When the firearm is discharged by operation of the firing mechanism (not shown) the operating slide, which is locked to the barrel by the coengaging surfaces 45 and 47, initially moves rearwardly with the barrel in response to recoil providing a delay period during which the breech remains locked in closed position, the bullet leaves the barrel and the pressure within the barrel and the chamber are relieved. Further rearward movement of the slide independently of the barrel causes the extractor 12 to pull the spent cartridge out of the chamber. The rearwardly moving cartridge C, held in its extracting and ejecting position by the extractor 12, is moved downwardly across the face of the breech 50 by the downwardly moving chamber end of the barrel thereby presenting the base surface of the cartridge to the ejector 32, which is mounted in fixed position at the opposite side of the frame from the extractor claw 12 carried by the slide. Thus, the extractor claw 56 is disposed in generally diametrically opposed relation to the ejector 32 relative to the cartridge base and engages a portion of the cartridge rim in generally diametrically opposed relation to the ejector. The cartridge is free to pivot a sufficient distance relative to the extractor to allow release of the cartridge rim from the extractor 12. Because of the relative positions of the extractor claw and the ejector the force of the ejector against the base surface of the cartridge case causes the spent cartridge case to pivot about the extractor claw and flip upwardly and outwardly through the ejection port 48. Thereafter, the extractor is returned to its inactive position by the biasing force of the extractor front pin 14 and the extractor spring 16 whereupon the cycle is repeated and the next round of ammunition is stripped from the magazine during return movement of the slide to battery position and loaded into the chamber in preparation for the next firing cycle.

Figure 15:
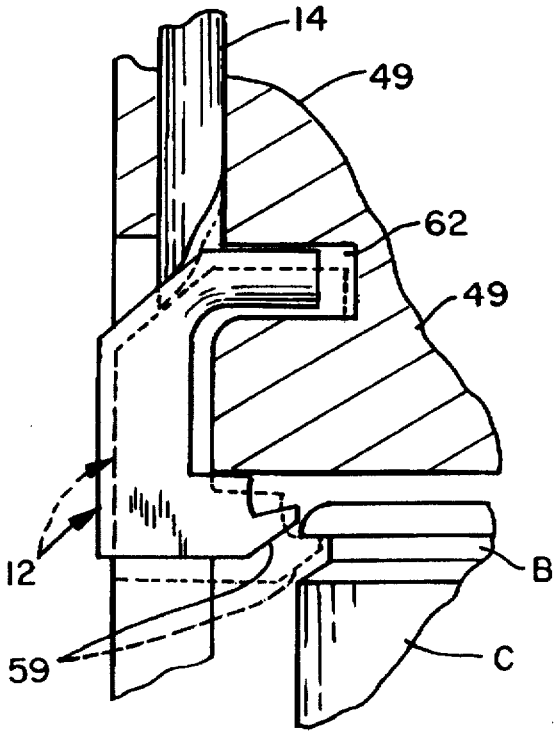
FIG. 15 is similar to FIG. 4 but shows the position of the extractor as the breech bolt portion of the operating slide closes on a chambered cartridge.

FIG. 15 illustrates the condition which occurs when the operating slide 38 is moved to battery position closing the breech on a chambered cartridge C. In this instance the cam surface 59 on the forward end of the extracting claw 56 engages the rim of the chambered cartridge and cams the claw laterally outwardly against the biasing force exerted upon the cam surface 60 by the front extractor pin 14 and the extractor spring 16. This camming action causes the extractor 12 to move laterally upwardly and outwardly from its inactive or broken line position of FIG. 15 and toward its full line position of FIG. 15 and relative to the slide to ultimately allow the claw to snap over the cartridge rim and assume an extracting position within the cannelure of the cartridge C. Thereafter, when the operating slide 38 moves from its battery to its retracted or retired position, the cartridge C will be withdrawn from the chamber. The extracting claw will remain locked in positive engagement with the cartridge rim for as long as the cartridge case remains in an extracting position with its axis extending longitudinally of the operating slide, that is throughout the extracting portion of the operating cycle and until the cartridge is presented by the extractor to the ejector for ejection from the firearm.

I claim:

1. In a firearm having a frame and an operating slide supported by the frame for reciprocal sliding movement longitudinally of said frame between battery and retired positions, a cartridge extractor having an extracting claw, mounting means for supporting said extractor on said operating slide for pivotal movement from an inactive position to an extracting position in response to engagement of said extracting claw with the rim of an associated cartridge supported within said firearm, said extracting claw in said extracting position being disposed within the cannelure of the associated cartridge, and a cam surface extending obliquely from said mounting means, biasing means for urging the cartridge extractor toward its inactive position, said biasing means having an arcuate cam surface engageable with the cam surface of said extractor, and arresting means for limiting the pivotal movement of said extractor from said inactive position to said extracting position to positively secure said extracting claw in engagement with the rim of the associated cartridge during the cartridge extracting portion of the operating cycle of said firearm.

2. The combination as set forth in claim 1 wherein said arresting means comprises coengageable surfaces on said operating slide and said cartridge extractor.

3. The combination as set forth in claim 2 wherein said coengageable surfaces include an abutment surface on said slide and an arresting surface on said claw.

4. The combination as set forth in claim 1 including a cartridge ejector mounted on said frame for cooperating with said cartridge ejector in said extracting position to eject the associated cartridge from the firearm during an ejecting portion of the operating cycle.

5. The combination as set forth in claim 4 wherein said cartridge ejector is mounted in fixed position on said frame.

6. The combination as set forth in claim 1 wherein said mounting means comprises a pivot point on said cartridge extractor engageable with a fulcrum defined by a surface of said operating slide.

7. The combination as set forth in claim 6 wherein said operating slide defines a cartridge extractor receiving recess and said fulcrum is defined by a portion of the surface of said recess.

8. The combination as set forth in claim 7 wherein said extractor is supported on said operating slide for pivotal movement about an axis generally upwardly and laterally inwardly inclined relative to the longitudinal axis of said slide and passing through said fulcrum.

9. The combination as set forth in claim 8 wherein said axis is disposed within a plane generally normal to the longitudinal axis of said operating slide.

10. The combination as set forth in claim 7 wherein said cartridge extractor has a longitudinally extending body portion and a pin projecting from one end of said body portion and having a free end defining said pivot point.

11. The combination as set forth in claim 10 wherein said extracting claw is integrally connected to the other end of said body portion.

12. The combination as set forth in claim 1 wherein said mounting means comprises a cartridge extractor receiving recess defined by said operating slide and a portion of said cartridge extractor is received within said recess.

13. The combination as set forth in claim 12 wherein said recess opens through one side of said operating slide and extends laterally downwardly and inwardly of said operating slide.

14. In a firearm having a frame and a longitudinally elongated operating slide supported by the frame for longitudinal reciprocal sliding movement between battery and retired positions relative to the frame, a cartridge extractor having an extracting claw, mounting means supporting said cartridge extractor for pivotal and lateral movement between inactive and extracting positions relative to said operating slide, and a cam surface extending obliquely from said mounting means, biasing means for urging said cartridge extractor toward said inactive position, said biasing means having an arcuate cam surface engageable with the cam surface of said extractor, said cartridge extractor being moveable to said cartridge extracting position in response to engagement with the rim of an associated cartridge during operational movement of said operating slide, said extracting claw being disposed within the cannelure of the associated cartridge and engaging the rim of the associated cartridge when said cartridge extractor is in said extracting position, and arresting means for limiting pivotal movement of said cartridge extractor from said inactive position to said cartridge extracting position to prevent escape of said extracting claw from the cannelure of the associated cartridge during the extracting portion of the operating cycle of said firearm.

15. The combination as set forth in claim 14 wherein said cartridge extractor is supported by said mounting means for pivotal movement about an axis extending laterally upwardly and inwardly relative to the longitudinal axis of said operating slide.

16. The combination as set forth in claim 15 wherein said axis is disposed within a plane generally normal to the longitudinal axis of said operating slide.

17. The combination as set forth in claim 14 including a cartridge ejector carried by said frame for cooperating with cartridge extractor in said extracting position during a portion of the movement of said operating slide from said battery to said retired position to eject the associated cartridge from said firearm.

18. The combination as set forth in claim 17 wherein said cartridge ejector is mounted in fixed position on said frame.

19. The combination as set forth in claim 17 wherein said arresting means comprises coengageable abutments on said operating slide and said cartridge extractor.

20. A firearm as set forth in claim 17 wherein said mounting means comprises a recess in said operating slide receiving an associated portion of said cartridge extractor therein.

21. The combination as set forth in claim 20 wherein said mounting means comprises a pivot point on said cartridge extractor engageable with a fulcrum defined by a portion of the surface of said operating slide disposed within said recess.

22. The combination as set forth in claim 21 wherein said extractor has a body portion and a pin integrally connected to and projecting from one end of said body portion and defining said pivot point.

23. The combination as set forth in claim 22 wherein said pin has a free end and said pivot point is defined by said free end.

24. The combination as set forth in claim 23 wherein said extracting claw is integrally connected to an end of said body portion opposite said one end.

* * * * *